US006686882B2

(12) United States Patent
Petros et al.

(10) Patent No.: US 6,686,882 B2
(45) Date of Patent: Feb. 3, 2004

(54) APPARATUS AND METHOD FOR TRANSFERRING DC POWER AND RF ENERGY THROUGH A DIELECTRIC FOR ANTENNA RECEPTION

(75) Inventors: Argy A. Petros, Lake Worth, FL (US); Anh Nguyen, Boynton Beach, FL (US)

(73) Assignee: XM Satellite Radio, Inc., Washington, DC (US)

( * ) Notice: Subject to any disclaimer, the term of this patent is extended or adjusted under 35 U.S.C. 154(b) by 0 days.

(21) Appl. No.: 09/982,112

(22) Filed: Oct. 19, 2001

(65) Prior Publication Data

US 2002/0060646 A1 May 23, 2002

Related U.S. Application Data

(63) Continuation-in-part of application No. 09/844,699, filed on Apr. 30, 2000.

(60) Provisional application No. 60/241,361, filed on Oct. 19, 2000, and provisional application No. 60/241,362, filed on Oct. 19, 2000.

(51) Int. Cl.[7] ..... H01Q 1/32

(52) U.S. Cl. ..... 343/700 MS; 343/715; 343/713

(58) Field of Search ..... 343/711, 712, 343/713, 715, 700 MS

(56) References Cited

U.S. PATENT DOCUMENTS

| | | | | |
|---|---|---|---|---|
| 4,109,214 | A | 8/1978 | Main | 330/254 |
| 4,109,251 | A | 8/1978 | MacDougall | 343/715 |
| 4,238,199 | A | 12/1980 | Rothbühr et al. | 23/314 |
| 4,238,799 | A | 12/1980 | Parfitt | 343/715 |
| 4,266,227 | A | 5/1981 | Blaese | 343/715 |
| 4,621,243 | A | 11/1986 | Harada | 333/24 R |
| 4,692,770 | A | 9/1987 | Kadokura | 343/715 |
| 4,764,773 | A | 8/1988 | Larsen et al. | 343/713 |
| 4,779,098 | A | 10/1988 | Blaese | 343/715 |
| 4,794,319 | A | 12/1988 | Shimazaki | 343/715 |
| 4,825,217 | A | 4/1989 | Choi | 343/715 |
| 4,882,592 | A | 11/1989 | Studer, Jr. et al. | 343/715 |
| 4,916,456 | A | 4/1990 | Shyu | 343/713 |
| 5,057,847 | A | 10/1991 | Väisänen | 343/702 |
| RE33,743 | E | 11/1991 | Blaese | 343/715 |

(List continued on next page.)

FOREIGN PATENT DOCUMENTS

| | | | |
|---|---|---|---|
| JP | 6260815 | 9/1994 | H01P/5/02 |

*Primary Examiner*—James Clinger
(74) *Attorney, Agent, or Firm*—Roylance, Abrams, Berdo & Goodman, LLP

(57) ABSTRACT

An antenna system is provided which employs RF and DC coupling across a dielectric. RF coupling is achieved using low cost and low loss RF coupler pairs such as quarterwave patches that are mounted opposite each other on either side of a dielectric. The feeds of the patches are aligned so as to be directly opposite each other, and the patches are mounted against the dielectric. A voltage booster circuit can be provided to increase input supply voltage for DC coupling that is adjustable to accommodate the thickness of the dielectric.

11 Claims, 11 Drawing Sheets

U.S. PATENT DOCUMENTS

| | | | | | |
|---|---|---|---|---|---|
| 5,099,251 | A | | 3/1992 | Fisher | 343/715 |
| 5,105,201 | A | | 4/1992 | Nakase et al. | 343/715 |
| 5,134,486 | A | | 7/1992 | Suzuki et al. | 358/190 |
| 5,161,255 | A | | 11/1992 | Tsuchiya | 455/345 |
| 5,212,492 | A | | 5/1993 | Jesman et al. | 343/713 |
| 5,278,572 | A | | 1/1994 | Harada et al. | 343/715 |
| 5,283,589 | A | * | 2/1994 | Blevins | 343/715 |
| 5,298,907 | A | | 3/1994 | Klein | 343/715 |
| 5,357,262 | A | | 10/1994 | Blaese | 343/906 |
| 5,422,681 | A | | 6/1995 | Hayashi | 348/730 |
| 5,451,966 | A | | 9/1995 | Du et al. | 343/715 |
| 5,557,290 | A | | 9/1996 | Watanabe | 343/713 |
| 5,734,355 | A | * | 3/1998 | Watanabe | 343/859 |
| 5,850,199 | A | | 12/1998 | Wan et al. | 343/757 |
| 5,872,549 | A | | 2/1999 | Huynh et al. | 343/895 |
| 5,898,407 | A | | 4/1999 | Paulus et al. | 343/713 |
| 5,898,408 | A | | 4/1999 | Du | 343/715 |
| 5,929,718 | A | | 7/1999 | Crosby | 333/24 R |
| 6,069,588 | A | | 5/2000 | O'Neill, Jr. | 343/713 |
| 6,097,345 | A | | 8/2000 | Walton | 343/769 |
| 6,140,966 | A | * | 10/2000 | Pankinaho | 343/700 MS |
| 6,232,926 | B1 | | 5/2001 | Nguyen et al. | 343/713 |

* cited by examiner

APPARATUS AND METHOD FOR TRANSFERRING DC POWER AND RF ENERGY THROUGH A DIELECTRIC FOR ANTENNA RECEPTION

The application is a continuation-in-part of U.S. application Ser. No. 09/844,699, filed Apr. 30, 2000, the entire content of which is expressly incorporated herein by reference.

This application claims benefit under 35 U.S.C. §119(e) of U.S. provisional patent application Serial No. 60/241,361, filed Oct. 19, 2000; and U.S. provisional patent application Serial No. 60/241,362, filed Oct. 19, 2000; the entire content of each of these applications being expressly incorporated herein by reference.

FIELD OF THE INVENTION

The invention relates generally to transmission of radio frequency signals (e.g., SDARS signals) from an antenna across a dielectric such as glass to a receiver disposed in a vehicle, as well as the transmission across glass of power from the receiver to antenna electronics. The invention also relates to an antenna system having DC and RF coupling across a dielectric which uses a relatively low supply voltage and low loss circuit boards and patch arrangement for optimal RF coupling.

BACKGROUND OF THE INVENTION

With reference to FIG. 1, a number of antenna systems have been proposed which provide for the transfer of radio frequency (RF) energy through glass or other dielectric surface to avoid having to drill holes, for example, through the windshield or window of an automobile for installation. Glass-mount antenna systems ate advantageous because they obviate the necessity of having to provide a proper seal around an installation hole or other window opening in order to protect the interior of the vehicle and its occupants from exposure to external weather conditions.

In the conventional antenna system 20 depicted in FIG. 1, RF signals from an antenna 22 are conducted across a glass surface 24 via a coupling device 26 that typically employs capacitive coupling, slot coupling or aperture coupling. The portion of the coupling device 26 on the interior of the vehicle is connected to a matching circuit 28 which provides the RF signals to a low noise amplifier (LNA) 32 at the input of a receiver 34 via an RF or coaxial cable 30. The matching circuit 28 can comprise passive components or traces on a circuit board, for example. The antenna system 20 is disadvantageous because the matching circuit 28, losses associated with the cable 30 and RF coupling (e.g., on the order of 2 to 4 dB or more) cause an increase in system noise. RF coupling losses increase as frequency increases. To reduce coupling losses, a conventional antenna system 20 is preferably implemented using ceramic compositions for circuit boards that are relatively expensive (e.g., Rogers 3003, 4003, 3010, and the like available from Rogers Corporation, Chandler, Ariz.). The cost associated with using these types of materials is 5 times that of a standard FR4 circuit board. A need therefore exists for an antenna system that achieves low RF coupling loss using low cost circuit boards.

Another proposed antenna system 40, which is described with reference to FIG. 2, has an RF coupling device similar to that used in the antenna system 20 depicted in FIG. 1, as well as DC coupling components to provide power to the antenna electronic circuitry. The antenna system 40 is configured to transmit video signals from satellite antenna electronics through a glass window 46 into a structure such as a residence or office building without requiring a hole through the glass. An exterior module 42 is mounted, for example, on the exterior of the structure, while an interior module 44 and receiver 48 are provided within the structure. RF coupling units 50*a* and 50*b* are provided on opposite sides of the glass 46 which is typically a window in the building. RF coupling unit 50*b* is connected to the exterior module 42 via a coaxial cable 54 to allow the exterior module 42 to be located remotely therefrom (e.g., on the building rooftop). The exterior module 42 encloses an antenna 52 and associated electronics (e.g., an LNA 56) to receive RF signals, which are then provided from the LNA 56 to the coupling device 50*b* via the cable 54 for transfer through the glass 46.

With continued reference to FIG. 2, RF energy transferred through the glass 46 is processed via a matching circuit 58. The matching circuit 28 is connected to a receiver 48 by another coaxial cable 60. In addition, DC power is provided from the interior module 44 to the exterior module 42 (e.g., to provide power for the LNA 48) by low frequency coupling coils 62*a* and 62*b* mounted opposite each other on either side of the glass 46. In a conventional satellite TV system, electrical power for the satellite antenna electronics is provided from the receiver 48 on the same coaxial cable that provides video signals from the antenna 52 to the receiver 48.

While the provision of DC power to antenna electronics is useful, the matching circuit and cable losses associated with the antenna system 40 are not desirable for such applications as a Satellite Digital Audio Radio Services (SDARS) system antenna for a vehicle. At 800 MHz, the coupling loss experienced with conventional glass mount antenna arrangements can be as much as 3 dB. At higher frequencies, the coupling loss increases substantially. For such high frequency applications as satellite radio operating at 2.4 GHz, the coupling loss is expected to be unacceptably high (e.g., 2 to 4 dB), making reception difficult. A need therefore exists for a glass or other dielectric-mounted antenna arrangement for high frequency wireless communication applications, and particularly, satellite radio applications, that reduces coupling loss and that is also compact.

Further, noise temperature is a significant parameter in an antenna system such as one that receives a satellite signal which is then amplified by an LNA. The noise temperature needs to be as low as possible. A need therefore exists for an antenna system that achieves that transfer of DC power across a dielectric (e.g., from the inside to the outside of a vehicle through the windshield) without significant degradation on system noise temperature.

SUMMARY OF THE INVENTION

The above described disadvantages are overcome and a number of advantages ate realized by an antenna system whereby RF coupling devices for mounting on opposite sides of a dielectric are made of low cost and low loss materials, and the transfer of RF energy across the dielectric occurs without significant degradation due to increased system noise.

The RF coupling devices ate also compact in design. Quarterwave patches are mounted on a circuit board and attached to a dielectric such that the patch is against the dielectric. The patch is provided with one or mote feeds, depending on the number of RF signals to be processed.

In accordance with another aspect of the present invention, the antenna system achieves DC coupling across the dielectric even though the supply voltage (e.g., the voltage supplied from a tuner to an antenna module located on the opposite side of a dielectric) is relatively low (e.g., 5 volts, as opposed to between 12 and 18 volts).

In accordance with an embodiment of the present invention, a DC voltage supplied on one side of a dielectric is increased to a higher voltage and then converted to an AC voltage to transfer electrical power across a dielectric via magnetic inductance.

In accordance with another aspect of the present invention, the DC coupling is not enabled until the interior antenna assembly is connected to the receiver and the receiver is powered on.

BRIEF DESCRIPTION OF THE DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

Figure 1:
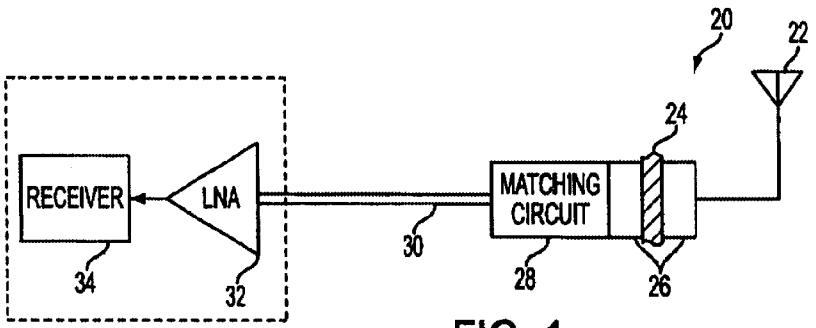
FIG. 1 (PRIOR ART)
FIG. 1 depicts a conventional antenna system that allows transfer of RF energy across a dielectric such as glass.
Figure 2:
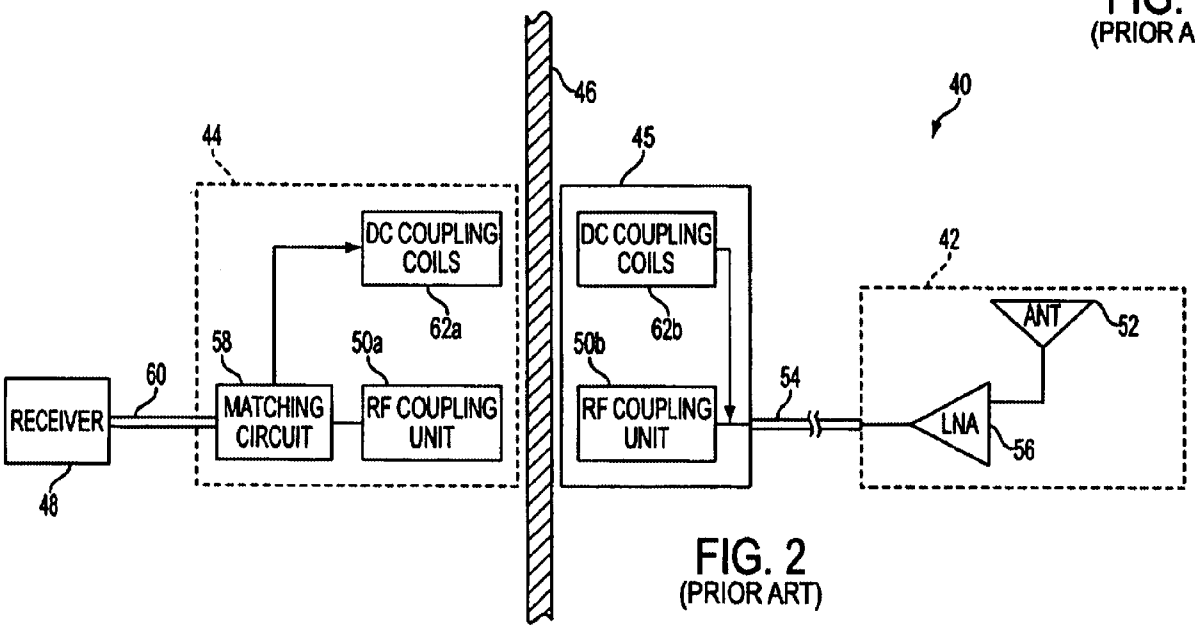
FIG. 2 (PRIOR ART)
FIG. 2 depicts a conventional antenna system for installation on a building for satellite reception of video signals.

The system depicted in FIG. 2 is generally a high voltage system, that is, the voltage supplied from an internal source is typically 12 volts to 18 volts. The voltage supplied outdoors, that is, through the dielectric to the externally mounted electronic components such as the LNA 56, is the voltage supplied from the internal source times its efficiency, which can be as low as 50%. Thus, the DC voltage supplied through the dielectric to the externally mounted electronic components is 6 to 9 volts. In satellite radio receivers such as receivers for SDARS, the receiver 48 supplies approximately 5 volts to the externally mounted antenna hardware. In accordance with the present invention, the antenna system is configured to deliver a minimum of 5 volts DC to externally mounted components when the internal supply voltage is only 5 volts.

Figure 3:
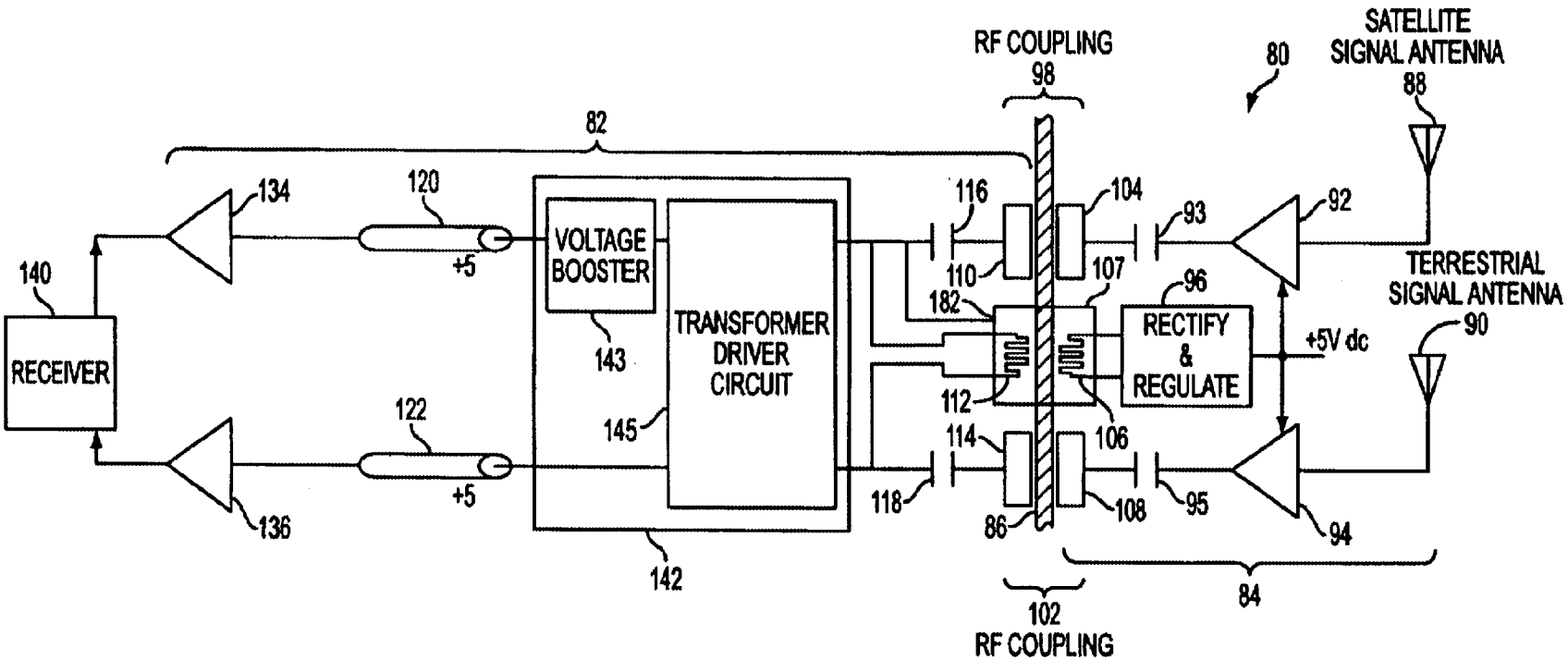
FIG. 3 is a schematic diagram of an antenna system constructed in accordance with an embodiment of the present invention.

With reference to FIG. 3, an antenna system 80 constructed in accordance with an embodiment of the present invention is shown. The antenna system 80 is configured for satellite reception (e.g., SDARS) at a vehicle. The antenna system comprises an interior module 82 for installation inside the vehicle (e.g., in the passenger or engine compartment of an automobile), and an exterior module 84 for installation on the exterior of a vehicle (e.g., on the front or rear windshield or a window of the vehicle). The interior module 82 and the exterior module 84 are preferably mounted on opposite sides of a dielectric such as glass 86 (e.g., an automobile windshield or window). The antenna system 80 preferably employs plural antennas (e.g., a satellite signal antenna 88 and a terrestrial signal antenna 90), and RF and DC coupling. The antenna system can also employ an integral antenna assembly for mounting on the exterior surface of the glass 86 as described in the above-referenced U.S. patent application Ser. No. 09/844,699.

As stated previously, the exemplary antenna system 80 illustrated in FIG. 3 comprises a satellite signal antenna 88 and a terrestrial signal antenna 90. Signals received via the antennas 88 and 90 are amplified as indicated at 92 and 94, respectively. The amplified signals are then provided, respectively, to RF coupling devices 98 and 102 via capacitors 93 and 95. The exterior module 84 preferably comprises patch antennas 104 and 108 for RF coupling that are mounted on the exterior of the glass 86 opposite patch antennas 110 and 114, respectively, provided in the interior module 82. The patch antenna pairs allow for transmission of RF energy corresponding to the amplified signals through the glass 86. It is to be understood that other RF coupling devices can be used such as capacitive plates or apertures or slot antennas. Thus, the exterior module 84 allows RF signals received via antennas mounted on the exterior of a vehicle to be provided to a receiver 140 inside the vehicle without the need for a hole in the windshield or window of the vehicle.

With continued reference to FIG. 3, the RF coupled signals from the antennas 88 and 90 are provided to respective coaxial cables 120 and 122 connected to the patch antennas 110 and 114 via corresponding capacitors 116 and 118. The cables 120 and 122 provide the received signals from the satellite and the terrestrial repeater, respectively, to amplifiers 134 and 136. The amplified signals at the corresponding outputs of the amplifiers 134 and 136 are provided to a receiver 140 for diversity combining and playback via loudspeakers in the vehicle, for example.

The present invention is advantageous in that the interior module 82 provides power to circuit components (e.g., the amplifiers 92 and 94) in the exterior module 84. The supply of power is preferably via DC coupling to also avoid the need for a hole in the windshield or window of the vehicle. DC power from a power source (e.g., a 5 volt DC battery provided in the vehicle) is converted to an AC power signal using a power circuit 142.

Figure 4:
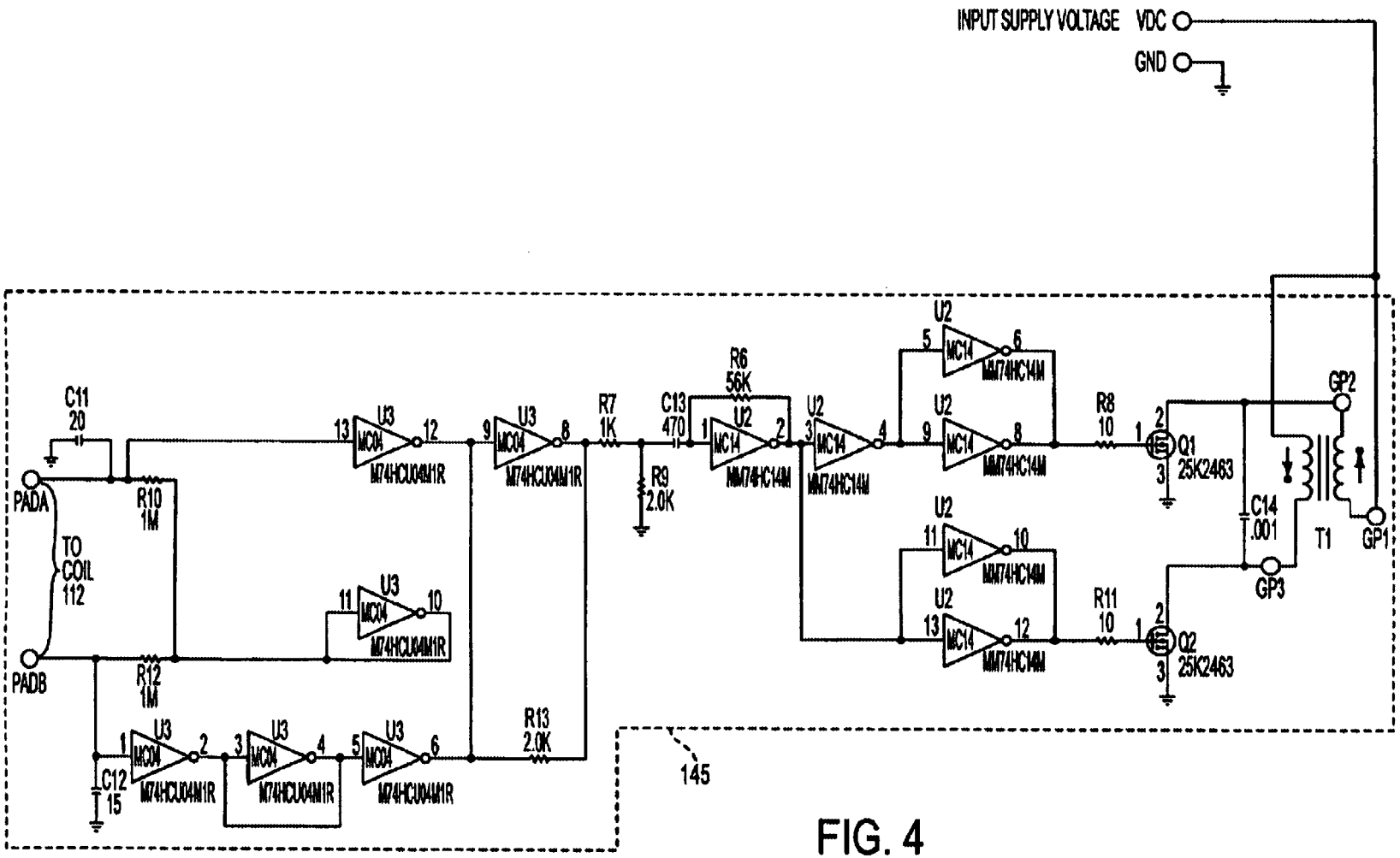
FIG. 4 is a schematic diagram of an interior coupling circuit for an antenna system constructed in accordance with an embodiment of the present invention.

The power circuit 142 preferably comprises an adjustable voltage booster circuit 143 and a transformer driver circuit 145, as shown in FIG. 4. The adjustable voltage booster circuit 143 is operable to receive a 5 volt DC input, which is available on both of the cables 120 and 122, and generate an output voltage that is increased and can also be adjusted, depending on the thickness of the dielectric 86. For example, the output voltage can be adjusted between 8 and 16 volts depending on the thickness of the dielectric. This is advantageous because vehicle windshield or window thickness can vary significantly, depending on the make and model of the vehicle. Thin windshields, for example, require a lower output voltage from the power circuit, thereby reducing overall current drain on the receiver 140. The present invention therefore allows the output voltage of the power circuit 142 to be adjusted to deliver the amount of DC power that is required while minimizing current drain on the receiver.

Figure 5:
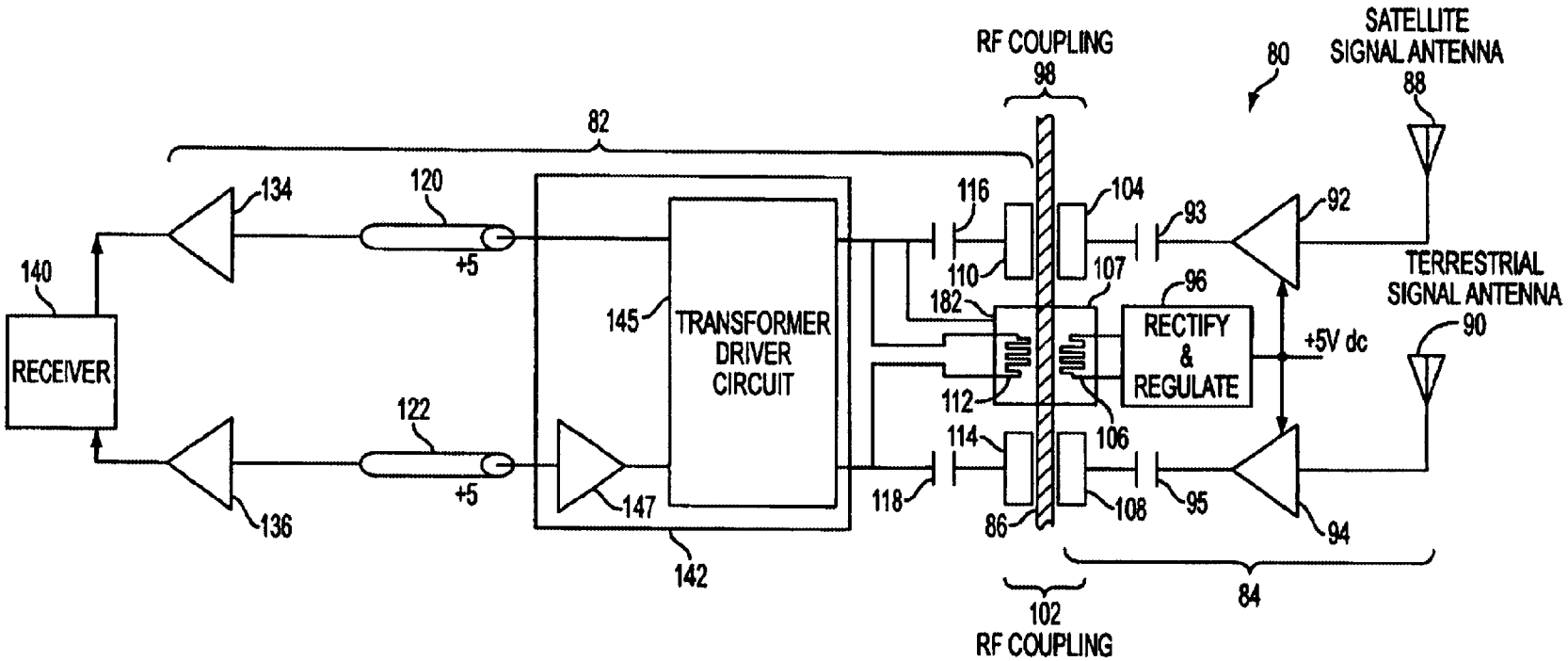
FIG. 5 is a schematic diagram of an interior coupling circuit for an antenna system constructed in accordance with an embodiment of the present invention.

The transformer driver circuit 145 shown in FIG. 4 is preferably disposed within the interior module 82, along with the adjustable voltage booster circuit 143. The transformer driver circuit 145 converts the DC power input from the adjustable voltage booster circuit 143 into an AC signal that can be transferred across the glass 86 to the exterior module 84. The transformer T1 and transistors Q1 and Q2 create an AC signal, along with a number of logic gates, that oscillates at a selected frequency. The terminals PADA and PADB allow for feedback (e.g., to determine if the frequency at each of the terminals is substantially the same). The coils 112 and 106 preferably have different turn ratios such that the AC signal applied to the exterior module 84 is less voltage than the AC signal generated in the interior module 82. The transformer driver circuit 145 preferably does not operate until the interior antenna assembly 82 is connected to the receiver 140 and the receiver 140 is powered on. Once connected, the receiver supplies 5 volts to the transformer driver circuit 145 via the cable 120 which enables the transformer driver circuit 145 to commence generation of an AC signal. In accordance with another embodiment of the present invention illustrated in FIG. 5, the power circuit 142 comprises a voltage inverter 147 to achieve a combination of +5 volts and −5 volts from the cables 120 and 122 and yield a 10 volt inside supply voltage, which is sufficient for providing DC power across a dielectric such as the windshields in many types of vehicles.

The magnetic coil 112 is preferably located in an interior housing and mounted on the interior of the glass 86 opposite an exterior housing enclosing a magnetic coil 106. The ratio of turns for the coils 112 and 106 are selected to transmit an AC power signal of selected voltage across the glass 86. The coil 106 is connected to a rectification and regulation circuit 96 that converts the AC signal transmitted across the glass 86 into a DC signal for supply to the amplifiers 92 and 94.

As stated above, conventional methods for coupling of RF energy through a dielectric are subject to losses from system noise (e.g., noise attributable to use of a matching circuit, cable losses, RF coupling losses, and so on) that have typically been mitigated by the use of expensive ceramic circuit board material. In accordance with another aspect of the present invention, the interior module 82 and the exterior module 84 are configured to achieve low coupling loss at high frequencies (e.g., as low as 2 dB for satellite applications such as global positioning system (GPS) applications and higher frequency applications). In accordance with embodiments of the present invention illustrated in FIGS. 6, 7A, 7B, 8A, 8B and 9, the interior module 82 and the exterior module 84 are preferably each provided with one or more RF couplers that are planar and relatively small (e.g., approximately one square inch at 2.3–2.4 GHz) and made of low cost and low loss, non-ceramic materials. The RF couplers allow for transfer of RF energy across a dielectric (e.g., between the inside and outside of a vehicle) without significant degradation due to increased system noise.

Figure 8A:
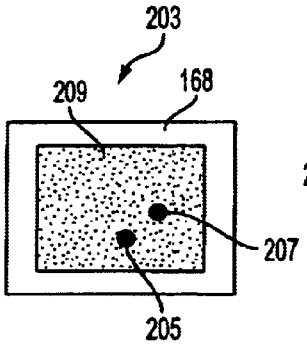
FIGS. 8A and 8B are front views of layers of an RF coupler constructed in accordance with an embodiment of the present invention.
Figure 8B:
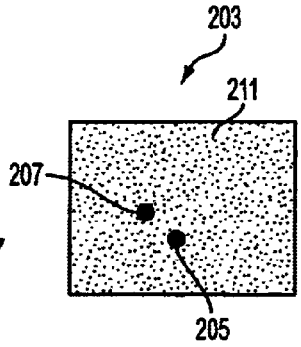
Figure 9:
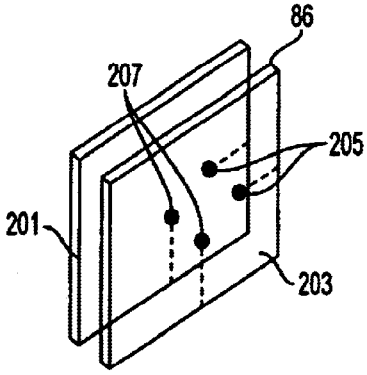
FIG. 9 is an isometric view of a pair of RF couplers constructed in accordance with an embodiment of the present invention.
Figure 10:
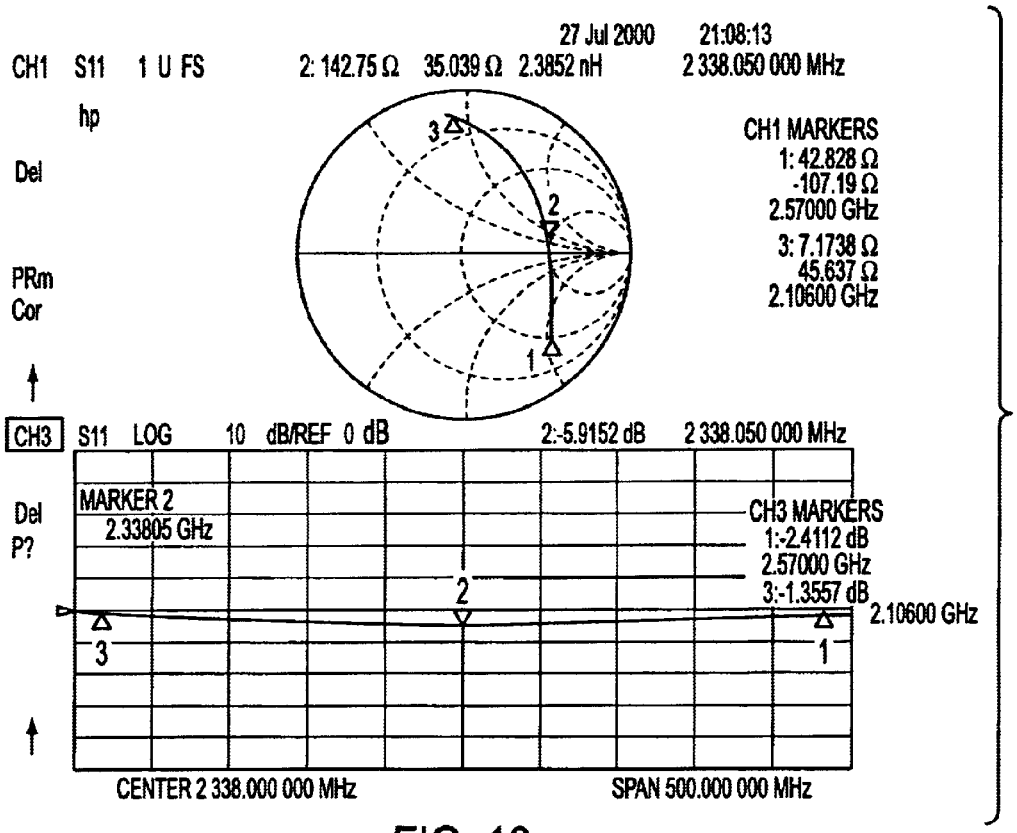
FIGS. 10 and 11 illustrate, respectively, VSWR characteristics of a conventional RF coupler and an RF coupler constructed in accordance with an embodiment of the present invention.
Figure 11:
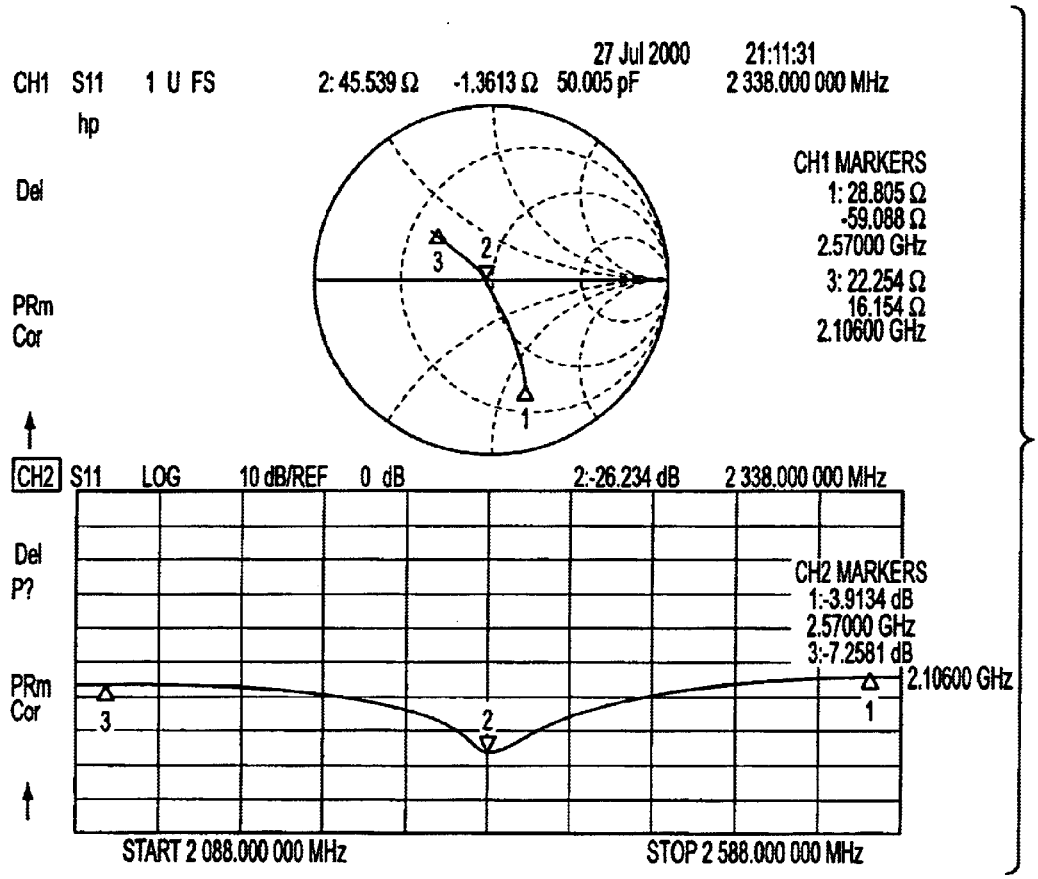

Individual RF couplers configured in accordance with different embodiments of the present invention ate described below in connection with FIGS. 6–8. FIG. 9 depicts an exemplary pair of RF couplers 201 and 203 which ate mounted opposite each other on each side of a dielectric surface (e.g., a dielectric 86 such as a glass vehicle windshield). The RF couplers 201 and 203 ate each preferably a quarterwave short-circuited patch. Patches are typically used as antennas. In accordance with the present invention, a pair of patches are configured for RF coupling. The impedance of this type of patch is not 50 ohm. The patches, therefore, are characterized by a poor voltage standing wave ratio (VSWR), as indicated in FIG. 10, and typically need matching circuits, the use of which can result in additional losses. The patches, that is, RF couplers 201 and 203 of the present invention, however, are configured such that, when they are mounted opposite each other on either side of the dielectric, they exhibit an excellent VSWR, as indicated in FIG. 11. In addition, the RF couplers of the present invention are relatively small (e.g., one square inch) and thin (e.g., 30 or 60 mils thick). While most larger RF couplers result in 2.5 dB or higher loss using expensive ceramic board material, the low cost RF couplers of the present invention achieve approximately 1.8 dB loss, for example, when etched in FR4.

The RF couplers 201 and 203 in FIG. 9 each have two feeds 205 and 207 for two RF signals such as the respective signals from the satellite antenna 88 and the terrestrial antenna 90. The feeds 205 and 207 are provided in essentially the same orthogonal locations on the RF couplers 201 and 203 such that they are able to process respective RF signals and are disposed opposite each other when the RF couplers 201 and 203 are mounted to the dielectric 86, as illustrated in FIG. 6.

Figure 6:
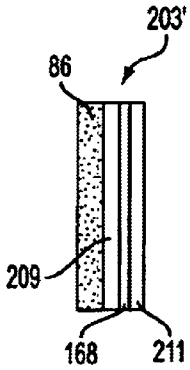
FIG. 6 is a side view of an RF coupler constructed in accordance with an embodiment of the present invention and mounted on a dielectric.
Figure 7A:
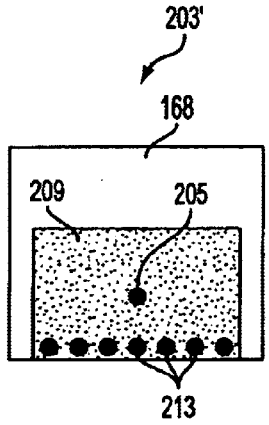
FIGS. 7A and 7B are front views of layers of an RF coupler constructed in accordance with an embodiment of the present invention.
Figure 7B:
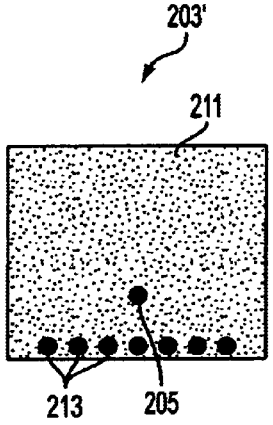

FIG. 6 and FIGS. 7A and 7B depict one RF coupler 203' of a pair of RF couplers similar to the pair depicted in FIG. 9. It is to be understood that the other RF coupler of the pair (not shown) is preferably identical to the RF coupler 203'. The RF coupler 203' comprises at least two layers 209 and 211, that is, a patch 209 and a grounded layer 211. The patch 209 is preferably adhered to the dielectric 86 in a conventional manner for coupling purposes. Thus, the patch of the present invention is distinguished from patch antennas which are typically mounted to a surface such that the patch faces away from the surface for reception purposes. The patch 209 is mounted on a circuit board, for example, such as the DC/RF coupling board 168 described below in connection with FIGS. 12 and 13. The grounded layer 211 is mounted on the other side of the circuit board and is preferably electrically connected to the patch 209 by a number of vias 213. The patch 209 and grounded layer 211 are each provided with a feed 205. Thus, two pairs of RF couplers are used, for example, to receive signals from the antennas 88 and 90, respectively. As shown in FIGS. 8A and 8B, the layers 209 and 211 of an RF coupler 203 can be provided with more than one feed to process a corresponding number of RF signals. The couplers 201 and 203 in FIG. 9, for example, have two feeds 205, 207 that are provided with the signals received from the antennas 88 and 90 respectively. The pair of patches illustrated in FIGS. 8A, 8B and 9 is therefore a more compact implementation for RF coupling than the use of two pairs of single feed patches. By way of an example, a one square inch pair of RF couplers 201 and 203 (FIG. 9) can isolate two signals by as much as 15 dB (e.g., via two polarizations). A third feed can be provided to the RF couplers 201 and 203 to accommodate a GPS signal, as well as a satellite signal and a terrestrial signal.

Figure 12:
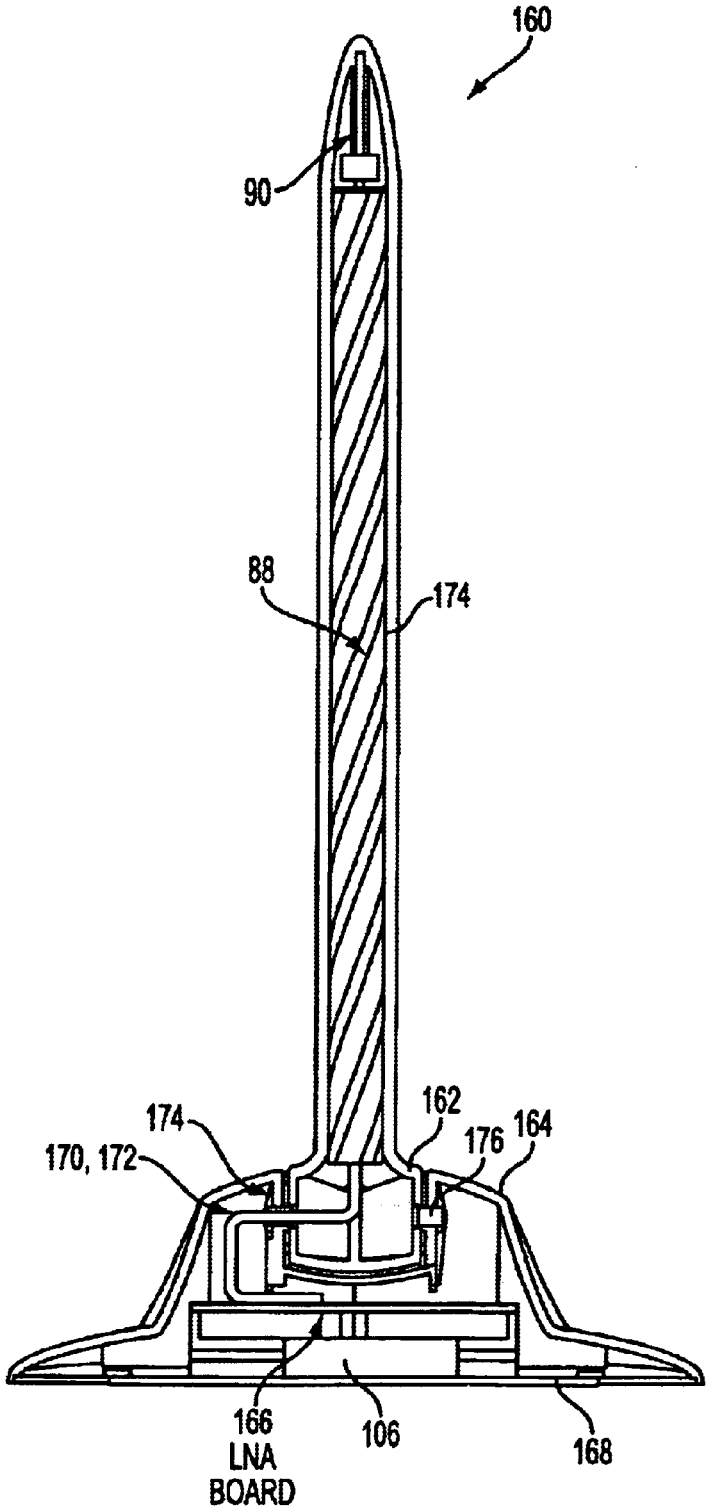
FIG. 12 is an elevational, cross-sectional view of an integral, glass-mounted antenna assembly constructed in accordance with an embodiment of the present invention.

In accordance with another aspect of the present invention, the exterior module 84 is an integral external antenna assembly 160, as depicted in FIG. 12. The antenna assembly 160 comprises a base housing 164, and an antenna housing 162 that is pivotably connected to the base housing 164 via bushings 174 and 176. A least one of the bushings 174 is preferably hollow and dimensioned to accommodate cables 170 and 172 connecting the satellite signal antenna 88 and the terrestrial signal dipole antenna 90, respectively, to a corresponding low noise amplifier (LNA) on an LNA circuit board 166. The bushings 174 and 176 preferably also function as pins about which the antenna housing 162 rotates.

With continued reference to FIG. 12, the base housing 164 is connected to the glass 86 in a conventional manner for glass-mounted antennas (e.g., using adhesive). The base housing 164 further comprises an exterior DC/RF coupling circuit board 168 comprising external RF couplers (e.g., patch antennas 104 and 108), as well as an exterior DC coupling device (e.g., the coil 106). The RF couplers ate preferably configured in accordance with the present invention, that is, as illustrated in FIGS. 6–9 and described above. The antenna housing 162 preferably comprises a quadrifilar antenna 88 for satellite signal reception and a linear dipole antenna 90 for terrestrial signal reception. The cable 170 is connected to the quadrifilar antenna which comprises strips that are disposed along a helical path on a cylindrical structure 174 within the antenna housing 162. The cable 172 is connected to a linear antenna that is disposed along the interior, longitudinal axis of the cylindrical structure 174 so as to be exposed above the cylindrical structure. The quadrifilar antenna 90 allows for the reception of signals from another satellite source. The external antenna assembly 160 can also be modified to include another antenna such as a GPS antenna if desired. The exterior antenna assembly 160 is advantageous because it encompasses plural antennas, RF and DC coupling and is a integrated design that does not have separate cables connecting it to a remote RF or DC coupling device.

The exterior DC/RF coupling circuit board 168 and the LNA board 166 are described below in connection with FIGS. 13 and 14, respectively. An exemplary interior DC/RF coupling circuit was described above with reference to FIGS. 3 and 4. The interior DC/RF coupling circuit is preferably disposed within the interior module 82. The RF signals received via the antennas 88 and 90 are transmitted across the glass 86 via the RF coupling devices (e.g., patch antennas) 110 and 114 and provided to a receiver 140 via the cables 120 and 122, respectively. The interior DC/RF coupling circuit preferably provides DC power to the exterior module 84 (e.g., the external antenna assembly 160) and can comprise a transformer driver circuit (e.g., circuit 145) for converting a DC power input into an AC signal that can be transferred across the glass 86 to the exterior module 84.

Figure 13:
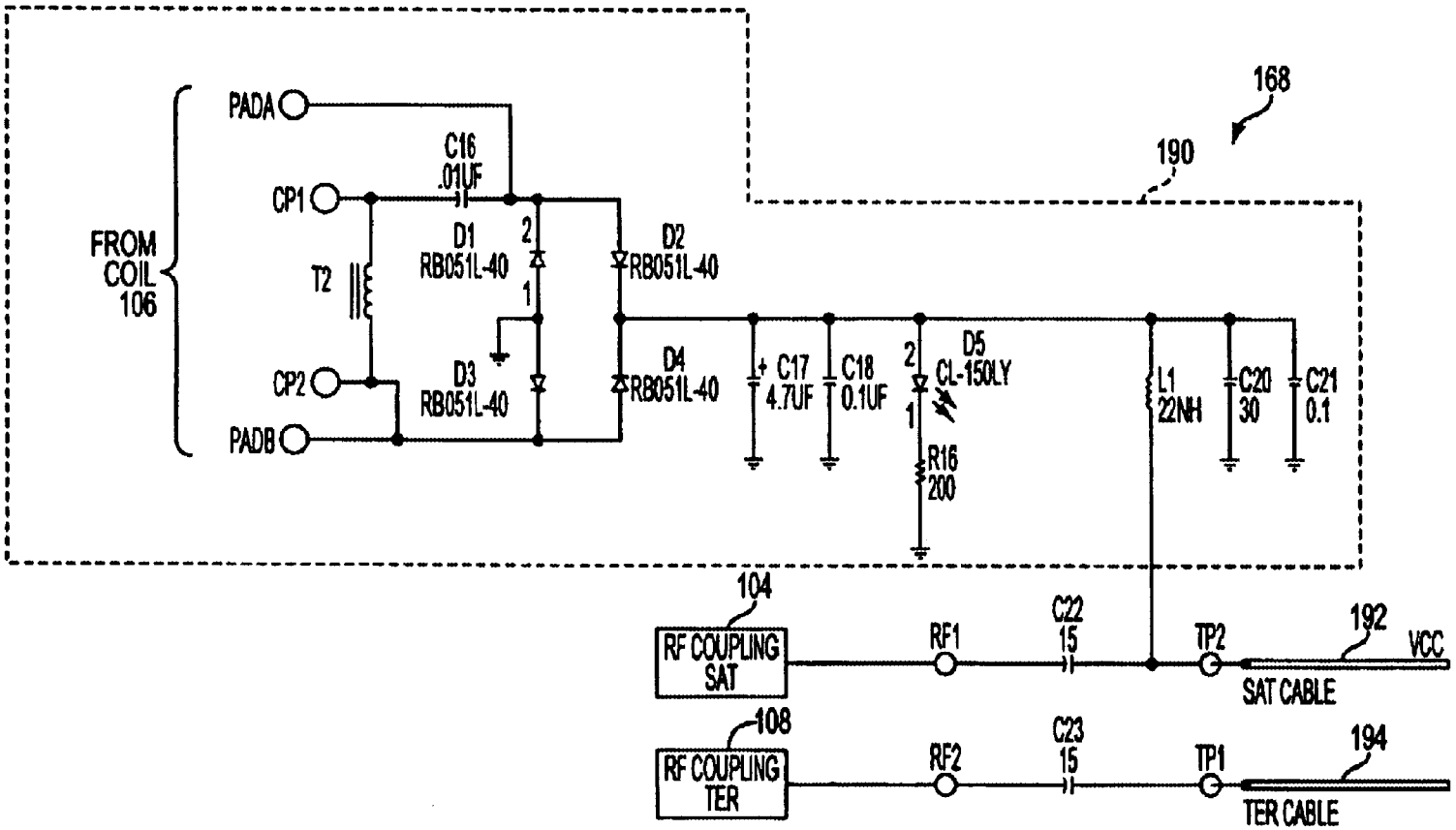
FIG. 13 is schematic diagram of an exterior coupling circuit for an antenna system constructed in accordance with an embodiment of the present invention.

With reference to FIG. 13, the AC signal is rectified via a rectification and regulation circuit 190 which converts the AC signal transferred across the glass 86 from the interior module 82 into a DC power signal. Cables 190 and 192 transport the RF signals received via the antennas 88 and 90 and conditioned via the LNA board 166 to the RF coupling devices 104 and 108, respectively (e.g., patch antennas). Although not shown in FIG. 12, cables 192 and 194 connect the boards 166 and 168. The DC signal need only be applied to the LNA board 166 via one of the cables such as the cable 192 in the illustrated embodiment.

Figure 14:
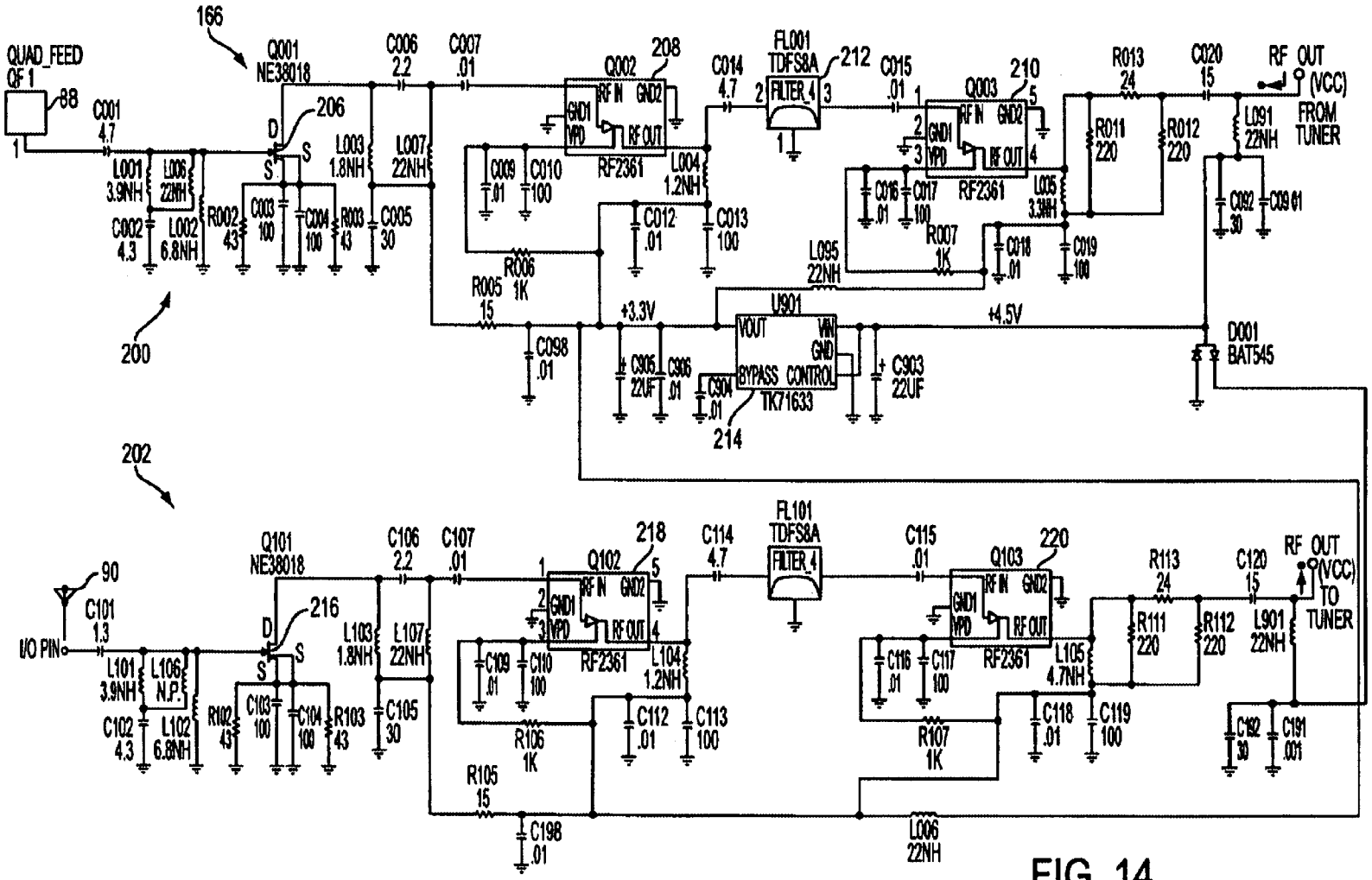
FIG. 14 is schematic diagram of a low noise amplifier circuit for an antenna system constructed in accordance with an embodiment of the present invention.

The LNA board 166 depicted in FIG. 14 preferably comprises three amplifier stages for each signal path, that is, for the satellite signal reception path 200 commencing with the satellite signal antenna 88 and for the terrestrial signal reception path 202 commencing with the terrestrial signal antenna 90. The gain can be as much as 34 dB. With regard to the signal path 200, the amplifier stages are indicated at 206, 208 and 210. A filter 212 is provided to reduce out-of-band interference and improve image rejection. In addition, a DC regulator 214 regulates the DC power signal received via the cable 192 (e.g., from 5 volts to 3.3 volts) to power the LNA board components. Similarly, the signal path 202 comprises amplifier stages indicated at 216, 218 and 220, as well as a filter 212 to reduce out-of-band interference.

In the illustrated example, two antennas 88 and 90 are used for signal reception, that is, a satellite signal antenna and a terrestrial signal antenna, respectively. A discussion now follows of the advantages of using a satellite signal antenna and a terrestrial signal antenna, and/or plural satellite signal antennas.

Radio frequency transmissions are often subjected to multipath fading. Signal blockages at receivers can occur due to physical obstructions between a transmitter and the receiver or service outages. For example, mobile receivers encounter physical obstructions when they pass through tunnels or travel near buildings or trees that impede line of sight (LOS) signal reception. Service outages can occur, on the other hand, when noise or cancellations of multipath signal reflections are sufficiently high with respect to the desired signal.

Communication systems can incorporate two or more transmission channels for transmitting the same program or data to mitigate the undesirable effects of fading or multipath. For example, a time diversity communication system delays the transmission of program material on one transmission channel by a selected time interval with respect to the transmission of the same program material on a second transmission channel. The duration of the time interval is determined by the duration of the service outage to be avoided. The non-delayed channel is delayed at the receiver so that the two channels can be combined, or the program material in the two channels selected, via receiver circuitry. One such time diversity system is a digital broadcast system (DBS) employing two satellite transmission channels.

A communication system that employs diversity combining uses a plurality of transmission channels to transmit the same source data or program material. For example, two or more satellites can be used to provide a corresponding number of transmission channels. A receiver on a fixed or mobile platform receives two or more signals transmitted via these different channels and selects the strongest of the signals or combines the signals. The signals can be transmitted at the same radio frequency using modulation resistant to multipath interference, or at different radio frequencies with or without modulation resistant to multipath. In either case, attenuation due to physical obstructions is minimized because the obstructions are seldom in the LOS of both satellites.

Accordingly, a satellite broadcast system can comprise at least one geostationary satellite for line of sight (LOS)

satellite signal reception at receivers. Another geostationary satellite at a different orbital position can be provided for diversity purposes. One or more terrestrial repeaters can be provided to repeat satellite signals from one of the satellites in geographic areas where LOS reception is obscured by tall buildings, hills and other obstructions. It is to be understood that different numbers of satellites can be used, and satellites in other types of orbits can be used. Alternatively, a broadcast signals can be sent using only a terrestrial transmission system. The satellite broadcast segment preferably includes the encoding of a broadcast channel into a time division multiplexed (DM) bit stream. The TDM bit stream is modulated prior to transmission via a satellite uplink antenna. The terrestrial repeater segment comprises a satellite downlink antenna and a receiver/demodulator to obtain a baseband TDM bitstream. The digital baseband signal is applied to a terrestrial waveform modulator, and is then frequency translated to a carrier frequency and amplified prior to transmission. Regardless of which satellite and terrestrial repeater arrangement is used, receivers are provided with corresponding antennas to receive signals transmitted from the satellites and/or terrestrial repeaters.

Figure 15:
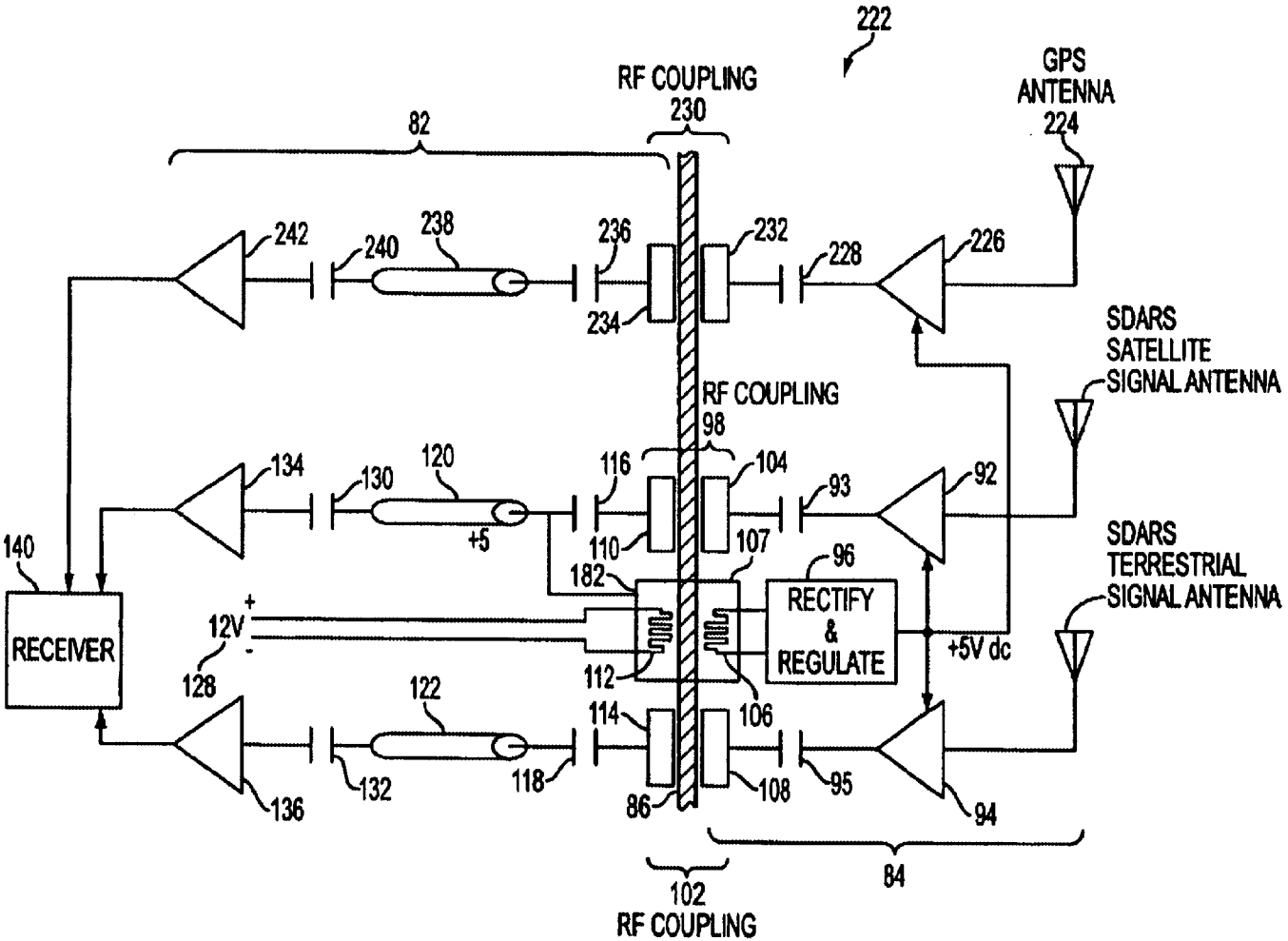
FIG. 15 is a schematic diagram of an antenna system constructed in accordance with an embodiment of the present invention.

The antenna assembly 222 depicted in FIG. 15 is similar to the antenna assembly 80 depicted in FIG. 4, except that the antenna assembly 222 further comprises another receiver arm for receiving GPS signals. A GPS antenna 224 provides received signals to an amplifier 226. The amplified signal is then provided to an RF coupling device 230 that comprises, for example, patch antennas 232 and 234 mounted on opposite sides of the glass 86. A coaxial able 238 in the interior module 82 provides the RF signal transferred through the glass 86 to an amplifier 242 which, in turn, provides the received signal to the receiver 140. The amplifier 226 can receive power from the interior module via the same DC coupling described above in connection with the other two satellite reception arms.

Although the present invention has been described with reference to a preferred embodiment thereof, it will be understood that the invention is not limited to the details thereof. Various modifications and substitutions will occur to those of ordinary skill in the art. All such substitutions are intended to be embraced within the scope of the invention as defined in the appended claims.

What is claimed is:

1. A radio frequency or RF coupling device for transferring an RF signal across a dielectric comprising:

a first patch device having a first feed through which said RF signal can be transmitted; and a second patch device having a second feed through which said RF signal can be transmitted, said second patch device and said first patch device comprising respective electrically conductive patches mounted on respective circuit boards, said second patch device and said first patch device being attached to opposite sides of said dielectric such that said patches are disposed directly against said dielectric;

wherein said first feed and said second feed are disposed on said first patch device and said second patch device, respectively, such that they are essentially directly opposite each other when said first patch device and said second patch device are attached to said dielectric.

2. An RF coupling device as claimed in claim 1, wherein at least one of said patches is a quarterwave patch.

3. An RF coupling device as claimed in claim 1, further comprising a grounding member mounted opposite respective ones of said patches on the other side of their corresponding said circuit boards.

4. An RF coupling device as claimed in claim 3, wherein each of said patches is electrically connected to its corresponding said grounding member using at least one via in the corresponding one of said circuit boards.

5. An RF coupling device as claimed in claim 1, wherein said first patch device and said second patch device each comprise a plurality of feeds for transferring a corresponding number of RF signals through said dielectric.

6. An RF coupling device as claimed in claim 1, wherein said RF coupling device is dimensioned to be approximately one square inch in area or less.

7. An RF coupling device as claimed in claim 1, wherein said RF coupling device is dimensioned to be approximately between 30 and 60 mils in thickness.

8. An RF coupling device as claimed in claim 1, wherein at least one of said circuit boards is composes of FR4 material and said patch is etched in said FR4 material.

9. An antenna system comprising:

an interior antenna assembly having a first radio frequency coupling device connected to a dielectric surface and a first direct current coupling device connected to said dielectric surface; and an exterior antenna assembly comprising at least one antenna for receiving a radio frequency signal, an amplifier for amplifying said radio frequency signal, a second radio frequency coupling device mounted opposite said first radio frequency coupling device on the other side of said dielectric surface for transferring said radio frequency signal thereto through said dielectric surface, and a second direct current coupling device mounted opposite said first direct current coupling device on the other side of said dielectric surface for receiving a power signal therefrom through said dielectric surface;

wherein said interior antenna assembly can be connected to a receiver that supplies power thereto, said interior antenna assembly comprising an alternating current signal generation circuit for generating an alternating current signal from a direct current source for transfer to said exterior antenna assembly via said first direct current coupling device and said second direct current coupling device, said alternating current signal generation circuit not operating to generate said alternating current signal until said interior antenna assembly is connected to said receiver and receiving power therefrom.

10. An antenna system as claimed in claim 9, wherein said interior antenna assembly comprises a voltage booster for increasing said power from said receiver.

11. An antenna system as claimed in claim 10, wherein said voltage booster is adjustable depending on the thickness of said dielectric surface to provide a selected amount of direct current to said exterior antenna assembly.

* * * * *

UNITED STATES PATENT AND TRADEMARK OFFICE

CERTIFICATE OF CORRECTION

PATENT NO. : 6,686,882 B2
DATED : October 19, 2001
INVENTOR(S) : Argy A. Petros and Anh Nguyen It is certified that error appears in the above-identified patent and that said Letters Patent is hereby corrected as shown below:

Title page,
Item [62], Related U.S. Application Data, should read as follows:
-- Continuation-in-part of application No. 09/844,699, filed on April 30, 2001 --.

Signed and Sealed this

Eleventh Day of May, 2004

JON W. DUDAS
*Acting Director of the United States Patent and Trademark Office*